US005867868A

United States Patent [19]

Ward

[11] Patent Number: 5,867,868

[45] Date of Patent: Feb. 9, 1999

[54] DETACHABLE GRIP FOR ELONGATED MEMBERS

[76] Inventor: James D. Ward, 8275 State Rte. 202, Tipp City, Ohio 45371

[21] Appl. No.: 869,457

[22] Filed: Jun. 5, 1997

[51] Int. Cl.[6] ..... A47B 95/02

[52] U.S. Cl. ..... 16/114 R; 16/111 R; 16/DIG. 12

[58] Field of Search ..... 16/114 R, 110 R, 16/111 R, DIG. 12, 116 R; 473/568; 294/25; 38/95; 2/20, 158–160; 81/177.1, 487

[56] References Cited

U.S. PATENT DOCUMENTS

| | | | |
|---|---|---|---|
| 1,008,604 | 11/1911 | Lake | 16/114 R |
| 1,648,354 | 11/1927 | Lied . | |
| 2,091,458 | 8/1937 | Sleight | 272/72 |
| 2,274,605 | 2/1942 | Hoffmeister | 16/114 R |
| 3,084,938 | 4/1963 | Kapanowski | 273/72 |
| 3,368,811 | 2/1968 | Finney | 273/72 |
| 3,739,932 | 6/1973 | Westover | 16/116 R |
| 3,868,110 | 2/1975 | Jones | 273/75 |
| 3,973,348 | 8/1976 | Shell | 43/23 |
| 4,072,311 | 2/1978 | Bertucci | 273/75 |
| 4,159,115 | 6/1979 | Ticktin et al. | 273/75 |
| 4,226,418 | 10/1980 | Balfour | 273/75 |
| 4,262,385 | 4/1981 | Norman | 16/114 R |
| 4,453,332 | 6/1984 | Wightman | 43/23 |
| 4,599,920 | 7/1986 | Schmid | 81/489 |
| 4,684,559 | 8/1987 | Wasko | 428/100 |
| 4,890,355 | 1/1990 | Schulten | 16/111 |
| 4,961,572 | 10/1990 | Badillo et al. | 273/75 |
| 5,011,145 | 4/1991 | Bartkowicz | 273/72 |
| 5,016,148 | 5/1991 | Kohm | 362/102 |
| 5,035,428 | 7/1991 | Bartkowicz | 273/72 |
| 5,184,815 | 2/1993 | Maddox | 273/26 |
| 5,219,458 | 6/1993 | Bencriscutto | 434/252 |
| 5,335,916 | 8/1994 | Nee | 2/160 |
| 5,364,677 | 11/1994 | Sendziak | 428/40 |
| 5,469,601 | 11/1995 | Jackson | 16/111 R |
| 5,482,270 | 1/1996 | Smith | 273/72 |
| 5,577,722 | 11/1996 | Glassberg | 273/26 |
| 5,588,651 | 12/1996 | Frost | 473/206 |

*Primary Examiner*—Chuck Y. Mah
*Attorney, Agent, or Firm*—Biebel & French LPA

[57] ABSTRACT

A detachable grip for placement about an elongated member is disclosed. The grip includes a resilient body member having an arcuate gripping surface adapted to conform to the outer surface of the elongated member. A plurality of outwardly extending curvilinear projections are adapted to conform to the shape of a hand of a user. First and second pairs of resilient securing members extend from the body member. Attachment means releasably attach distal ends of each pair of securing members to each other in an overlapping relationship around the elongated member.

18 Claims, 5 Drawing Sheets

DETACHABLE GRIP FOR ELONGATED MEMBERS

BACKGROUND OF THE INVENTION

1. Field of the Invention

The present invention relates to hand grips and, more particularly, to detachable and adjustable hand grips for placement around an elongated member to assist a user in securely and comfortably gripping the elongated member.

2. Description of the Prior Art

A common problem associated with the use of instruments having elongated handles, such as baseball bats, golf clubs, hammers, hoes, and the like, is that they tend to slip from the hands of the user during operation. An inadequate grip between the hands of the user and the handle of the instrument reduces the efficiency of the elongated member being utilized and often results in discomfort for the user. In particular, continuous slipping between the hands of the user and the handle of the instrument may result in the formation of blisters or callouses on the hands of the user. Additionally, an inadequate grip may result in dangerous situations, particularly when the elongated handle supports a sharp implement, such as an ax, or when the instrument is propelled at a great velocity.

One example of an instrument which is propelled at a high velocity is a baseball bat. Players and nearby spectators may be seriously injured by baseball bats which fly out of the user's hands. Consequently, there has been a longstanding, need for a device for improving the grip of a user in connection with baseball bats. In an effort to improve the user's grip and prevent such accidents, numerous precautionary measures have been employed, including coating the bat handle with rosin, applying pine tar, wearing thin high-friction gloves, and covering the bat handle with tape or other similar substances. However, these prior art methods and devices have proven ineffective in substantially improving the grip of the user on the baseball bat.

Additional attempts to solve the gripping problems associated with baseball bats have included hand grips permanently fixed to the handle of the bat. For example, many prior art grips have included protruding ridges or indented grooves formed within the bat handle itself. Not only have these prior art devices failed to solve the gripping problem, but have been found objectionable because they do not account for differing hand sizes of individual users nor for the variety of hand orientations of individual users in gripping the bat or positioning their hands. Further, since the hand grip becomes a permanent part of the bat handle, the grip is not interchangeable with other bats such that each bat must be customized for a single user.

Additionally, while it is well recognized that the proper grip of the bat is critical in the development of batting skills, prior art gripping devices have done little to facilitate the teaching of proper hand orientation upon the bat. Since the bat is cylindrical, it is often difficult for a novice batter to gain a proper understanding of proper hand orientation and to be able to repeat the proper orientation each time he or she picks up the bat.

Accordingly, there is a need for a detachable hand grip which may be releasably secured around the outside surface of an elongated handle of an instrument. Further, there is a need for a pair of such detachable hand grips which may be customized by the user in a desired orientation around the outside circumference of an elongated handle of an instrument to provide a secure, comfortable and effective grip.

SUMMARY OF THE INVENTION

The present invention provides a detachable hand grip for placement about an elongated member having a substantially arcuate outer surface. The detachable grip is easily secured to and released from the elongated member, such that the hand grip may be applied to a wide variety of different elongated members.

The detachable hand grip of the present invention includes a resilient body member having inner and outer surfaces. The outer surface is substantially defined by a plurality of outwardly extending curvilinear projections adapted to conform to the shape of a hand of a user. An arcuate gripping surface is defined by the inner surface of the body member and is adapted to conform to and releasably engage the outer surface of the elongated member. First and second pairs of resilient securing members extend outwardly from the body member. Each securing member has an inner surface, a proximal end connected to the body member and a distal end spaced a pre-determined distance from the proximal end. Attachment means are positioned proximate the distal end of at least one of the securing members. The attachment means releasably attach the distal ends of each pair of securing members to each other in an overlapping relationship around the outer surface of the elongated member. The arcuate gripping surface of the body member and the inner surface of each securing member is adapted to securely grip the outer surface of the elongated member when the distal ends of the securing members are releasably attached to each other, thereby preventing rotational or axial movement of the grip relative to the elongated member.

In an alternative embodiment of the present invention, a gripping device comprises first and second detachable grips which are placed around an elongated member. Each detachable grip has an identical structure as identified above, wherein the plurality of curvilinear projections of the first detachable grip are circumferentially offset relative to the curvilinear projections of the second detachable grip to thereby facilitate the proper hand orientation of the user upon the elongated member for optimum comfort and efficiency.

Therefore, it is an object of the present invention to provide a detachably mounted hand grip which may be easily installed and removed from an elongated member.

It is another object of the present invention to provide a detachably mounted hand grip which reduces the chances of unwanted release of an elongated member by the user.

It is yet another object of the present invention to provide a detachably mounted hand grip which facilitates the secure and comfortable grip of a user around an elongated member.

It is a further object of the present invention to provide a detachably mounted hand grip which may be interchangeably used with a wide variety of different elongated members.

It is still another object of the present invention to provide a detachably mounted hand grip which may be conveniently mounted on elongated members of different sizes.

It is a further object of the present invention to provide a detachably mounted gripping device which facilitates the proper hand orientation of the user on the elongated member, thereby facilitating the comfort and efficiency of the user.

Other objects and advantages of the invention will be apparent from the following description, the accompanying drawings and the appended claims.

DETAILED DESCRIPTION OF THE PREFERRED EMBODIMENT

Figure 1:
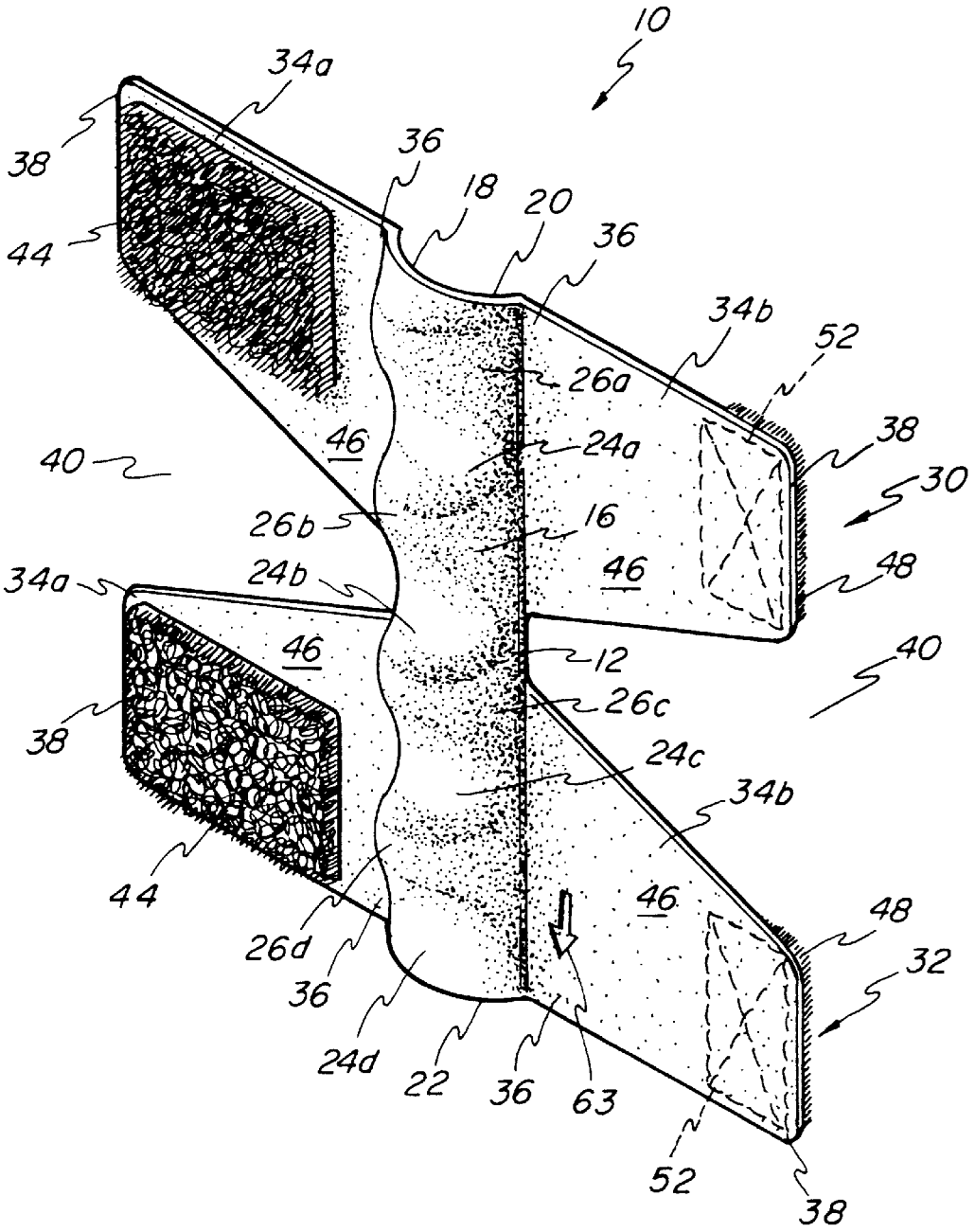
FIG. 1 is a perspective view of the detachable hand grip of the present invention.

Referring initially to FIGS. 1–7, the detachable hand grip 10 of the present invention is illustrated as including a resilient body member 12. The body member 12 includes both an inner surface 14 and an outer surface 16 wherein the inner surface 14 defines an arcuate gripping surface 18 extending from a first end 20 to a second end 22 of the body member 12. The outer surface 16 is adapted to conform to the shape of a user's hand to facilitate gripping thereof. More specifically, a plurality of alternating curvilinear recesses 24 and curvilinear projections 26 are formed within the outer surface 16 of the body member 12, which respectively conform to the fingers and spaces between the fingers of a user's hand. Thus, the fingers of a user's hand may comfortably rest within the curvilinear recesses 24 while the projections 26 generally conform to and are positioned in the spaces between the fingers of a user's hand.

Figure 6:
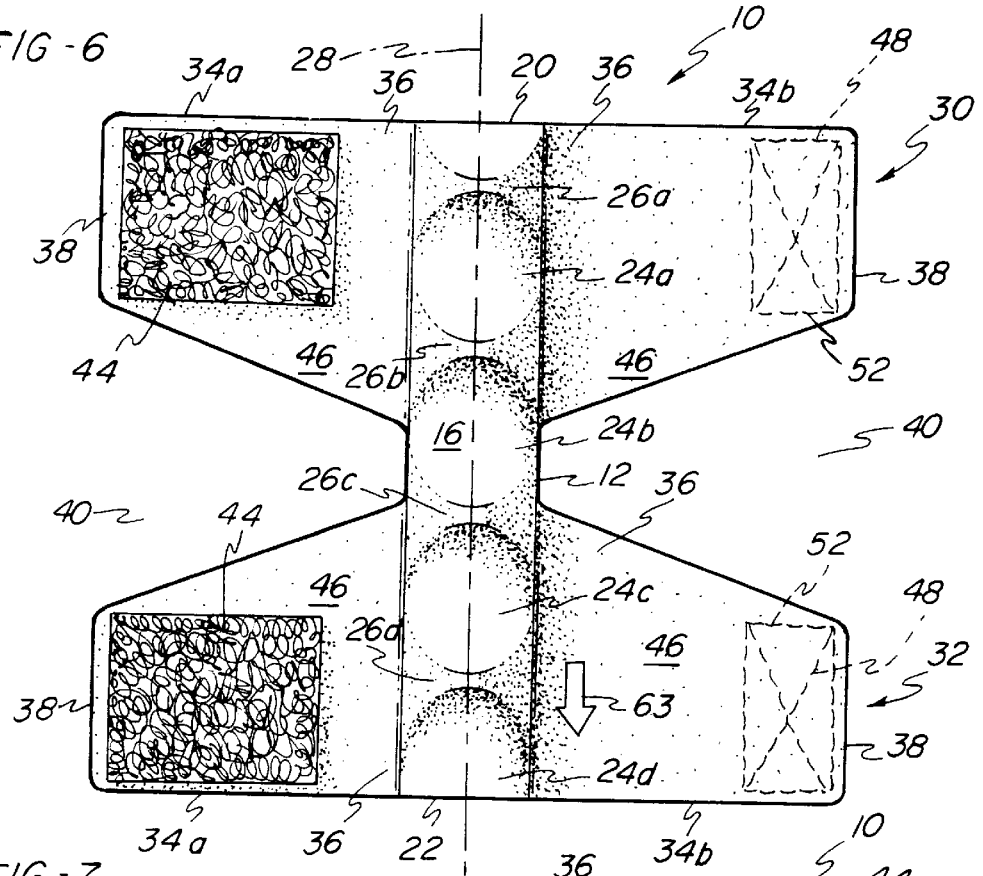
FIG. 6 is a top view thereof.

The curvilinear projections 26 include individual curvilinear projections 26*a*, 26*b*, 26*c* and 26*d* which are axially aligned along a longitudinal axis 28 (FIG. 6). Likewise, the curvilinear recesses 24 include individual curvilinear recesses 24*a*, 24*b*, 24*c* and 24*d* which are aligned along axis 28 (FIG. 6). It should be noted that projection 26*d* is spaced farther from the second end 22 of the body member 12 than projection 26*a* is spaced from the first end 20 of the body member 12. The additional spacing between the projection 24*d* and second end 22 provides for a recess 26*d* for accommodating a finger of the user's hand. While the projections 26 and recesses 24 are shown in the FIGS. 1 and 6 as being four in number, it is to be understood that this is for illustrative purposes only and in no way limits the scope of the invention.

Figure 2:
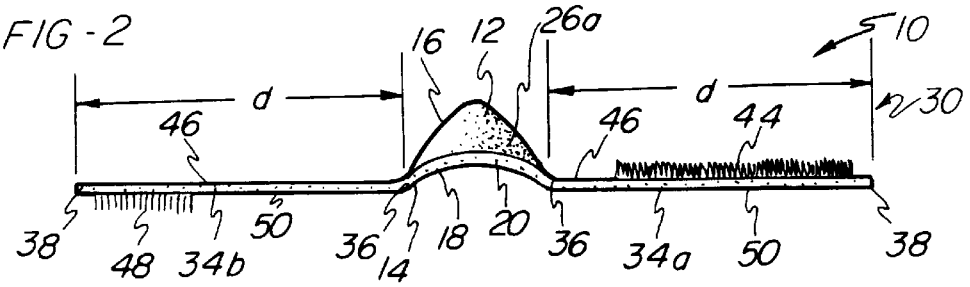
FIG. 2 is a front view thereof.
Figure 3:
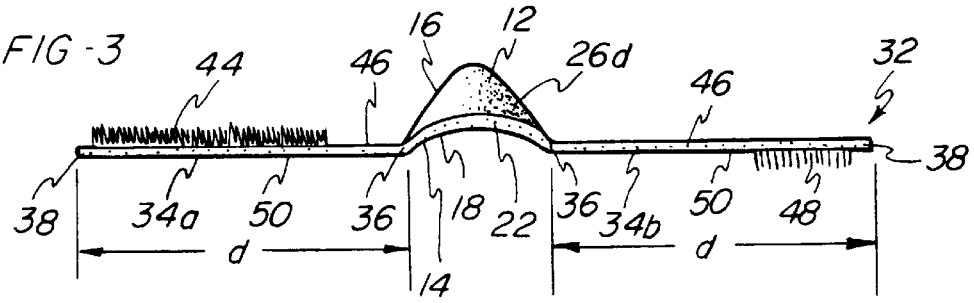
FIG. 3 is a rear view thereof.
Figure 4:
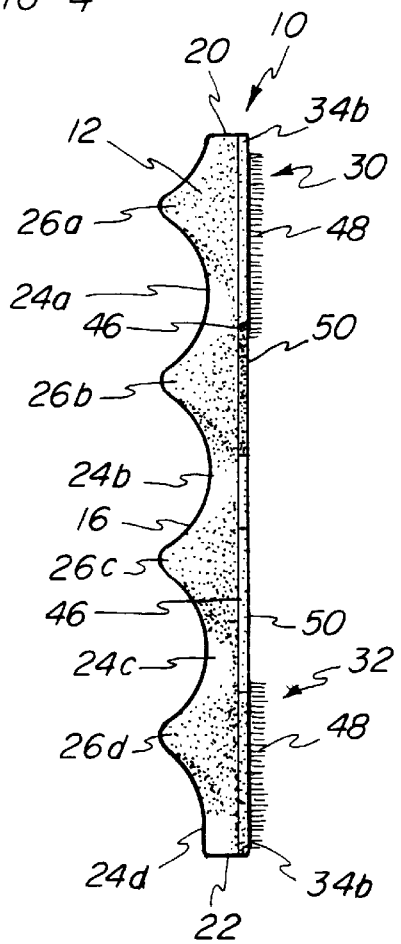
FIG. 4 is a right side view thereof.
Figure 5:
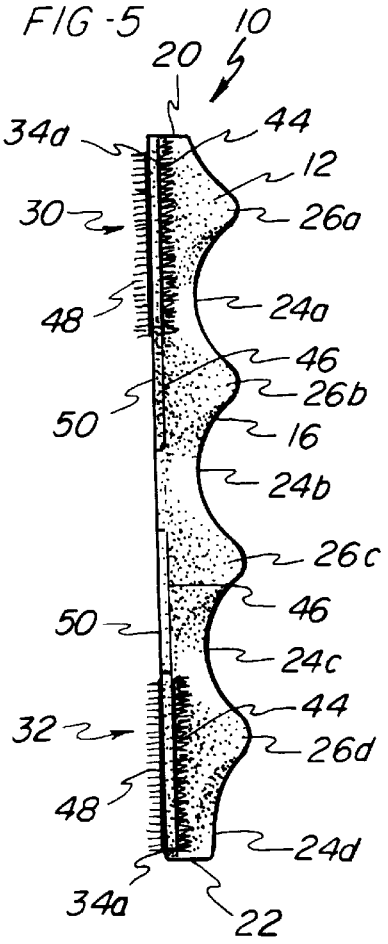
FIG. 5 is a left side view thereof.

First and second pairs 30 and 32 of resilient securing members 34 are integrally formed with the body member 12 from a resilient, yet non-slip material. It is preferred that the body member 12 and resilient securing members 34 are integrally molded from a thermoplastic rubber. Each pair 30 and 32 of resilient securing members 34 include first and second resilient securing members 34*a* and 34*b* having a proximal end 36 connected to the body member 12 and a distal end 38 in spaced relation to the proximal end 36. As illustrated in FIGS. 2 and 3, a predetermined distance "d" is defined between the proximal end 36 and distal end 38 of each resilient securing member 34.

Figure 7:
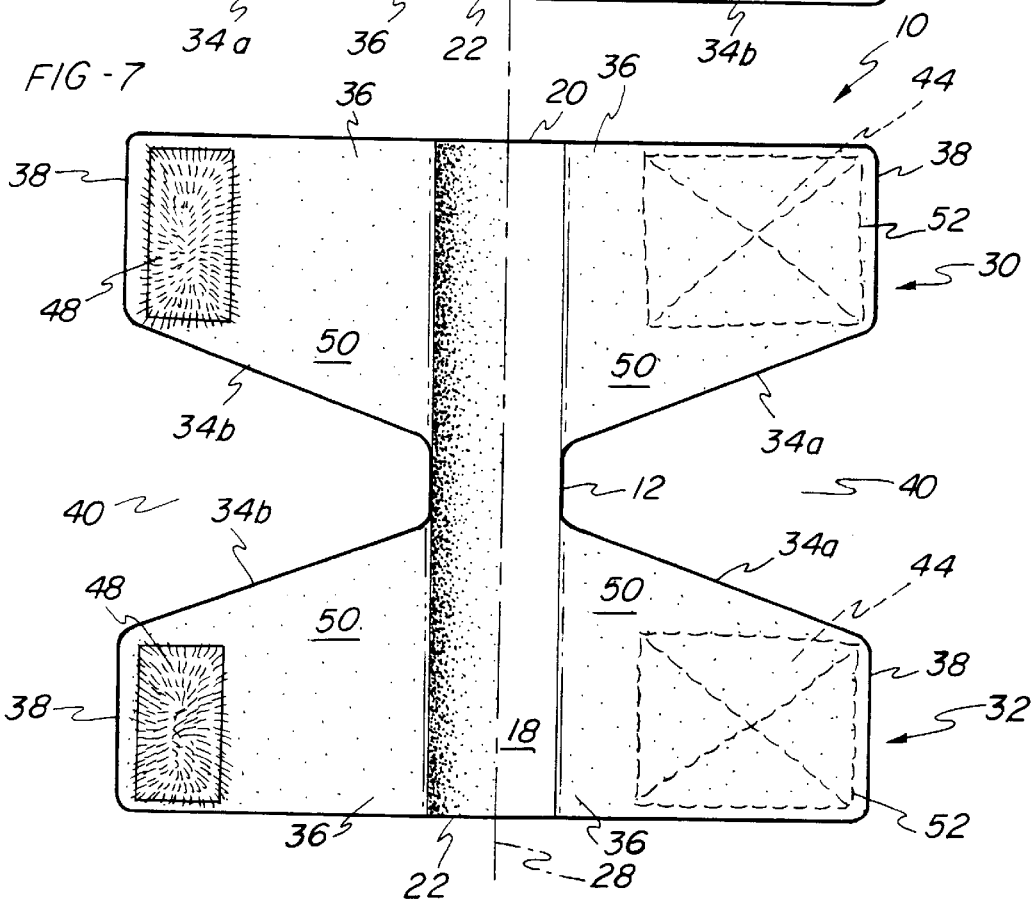
FIG. 7 is a bottom view thereof.

The proximal end 36 is preferably wider than the distal end 38 of each securing member 34 such that a tapered opening 40 is defined between the first and second pairs 30 and 32 of securing members 34. In FIGS. 1 and 6–7, the tapered opening 40 is illustrated as being substantially V-shaped, however, other configurations, such as an U-shaped opening, would perform equally well. The tapered opening 40 facilitates the positioning and application of the detachable grip 10 about a tapered or curved elongated member, as will be described later.

Attachment means are provided proximate at least one of the distal ends 38 within each pair 30 and 32 of resilient securing members 34. Preferably, the attachment means comprises a hook and loop fastener fixed to the securing members 34 such that a cloth or loop portion 44 is provided on the outer surface 46 of the first securing member 34*a* proximate the distal end 38. The hook portion 48 is provided on the inner surface 50 proximate the distal end 38 of the second mating resilient securing member 34*b*. The loop or cloth portion 44 and hook portion 48 are both preferably secured to resilient securing member 34*a* or 34*b*, respectively, by stitching 52, however, alternative securing means, including adhesive, double-faced tape or thermal bonding may be substituted therefor.

Figure 8:
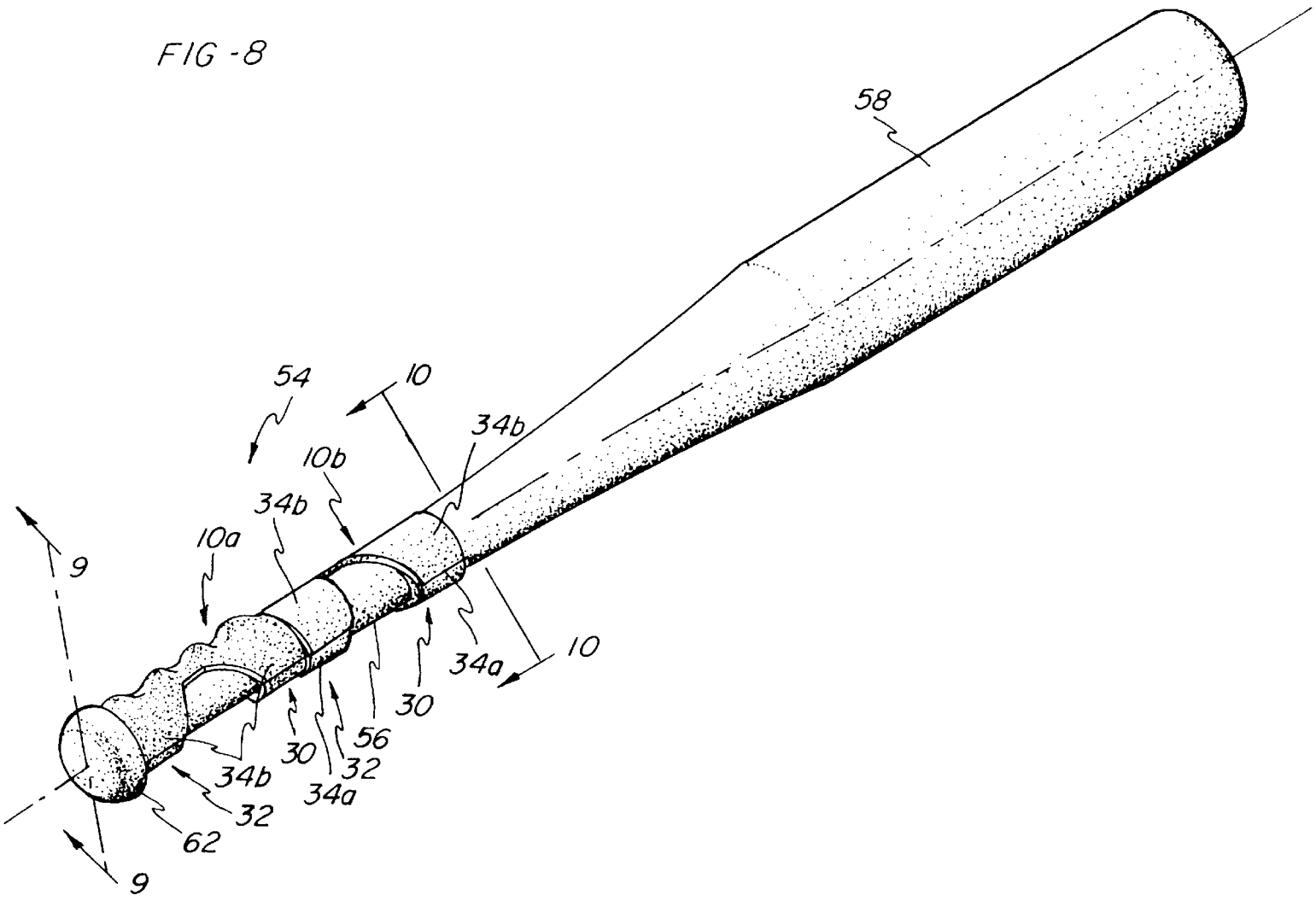
FIG. 8 is a perspective view of a pair of detachable hand grips of the present invention installed upon a baseball bat.
Figure 9:
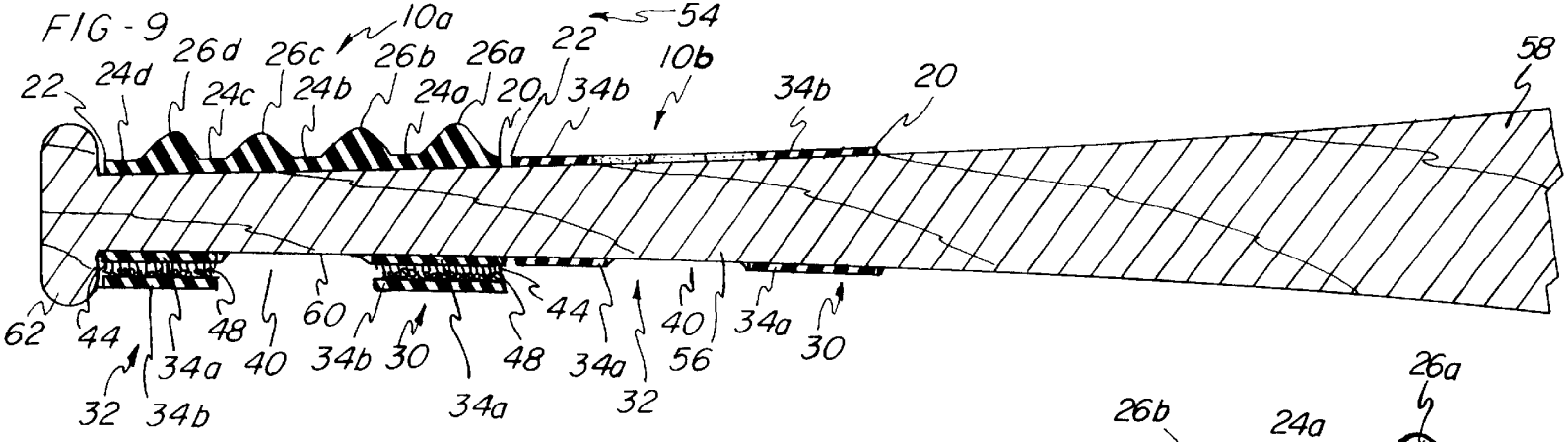
FIG. 9 is a cross-sectional view taken along line 9—9 of FIG. 8.
Figure 10:
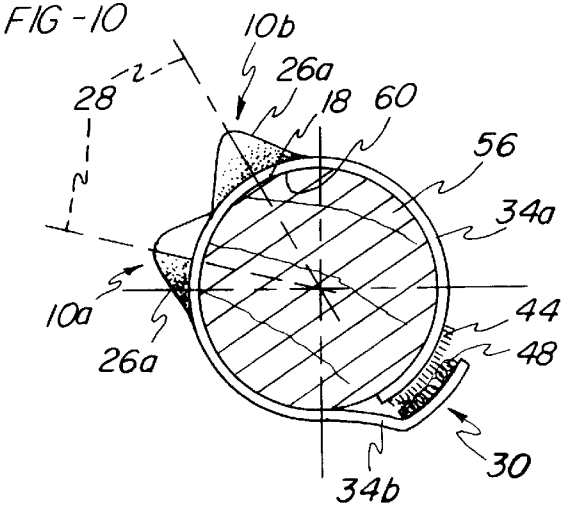
FIG. 10 is a cross-sectional view taken along line 10—10 of FIG. 8.

Turning now to FIGS. 8–10, a gripping device 54 comprising first and second detachable grips 10*a* and 10*b* is shown installed around the handle portion 56 of a baseball bat 58. Both grips 10*a* and 10*b* have the identical structure described above with respect to hand grip 10 of FIGS. 1–7. A baseball bat 58 is used in the following description for illustrative purposes only and it should be readily apparent that the detachable grips 10*a* and 10*b* of the present invention will find equal applicability with any elongated member.

In operation, the arcuate gripping surface 18 of the detachable grip 10*a* is placed in contact with the outer surface 60 of the handle portion 56 of the baseball bat 58. Recess 24*d* is placed adjacent the knob 62 of the bat 58 such that a finger of a user placed within recess 26*d* is secured between projection 26*d* and the knob 62. An indicating arrow 63 (FIGS. 1 and 6) is molded within the outer surface 46 of the securing member 34*b* of the second pair 32 of securing members 34 to facilitate proper positioning of the grip 10. More particularly, the indicating arrow 63 should be oriented downwardly so it is pointing towards the knob 62 and recess 24*d* defines the lower extremity of the grip 10*a*.

One of the first and second pairs 30 and 32 of resilient securing members 34 are next wrapped about the outer surface 60 of the handle portion 56. In particular, securing member 34*a* is wrapped around the outer surface 60 followed by securing member 34*b*. Both securing members 34*a* and 34*b* are then stretched such that they tightly encircle and engage the outer surface 60 of the handle portion 56. This stretching causes the distance "d" between the distal end 38 and proximal end 36 (FIGS. 2 and 3) of both securing members 34*a* and 34*b* to increase. The distal ends 38 of each securing member 34*a* and 34*b* are overlapped with each other and secured by the hook and loop fastener by the hook portion 48 engaging the loop portion 44 as best seen in FIG. 8. The remaining first or second pair 30 or 32 of resilient securing members 34 are secured to each other in an identical manner as with the first pair 30 of resilient securing members 34.

The second hand grip 10*b* is placed in contact with the handle portion 56 of the baseball bat 58 wherein the arcuate gripping surface 18 engages the outer surface 60 of the handle portion 56. The second end 22 of the second grip 10*b* is placed adjacent to the first end 20 of the first grip 10*a*. Once again, the indicating arrow 63 (FIGS. 1 and 6) is oriented downwardly such that the recess 24*d* defines the lower extremity of the grip 10*b*. The recess 24*d* of the second grip 10*b* thereby provides a location for a finger of the user's hand between projection 26*d* of the second grip 10*b* and projection 26*a* of the first grip 10*a*. The second grip 10*b* is then secured about the outer surface 60 of the handle portion 56 of the baseball bat 58 in an identical manner as described above with respect to the first grip 10*a*.

Either the first or second grips 10*a* or 10*b* may be easily released by pulling the distal end 38 of securing member 34*b* away from the distal end 38 of securing member 34*a*. The grips 10*a* and 10*b* may thereafter be rotated circumferentially or moved axially relative to the outer surface 60 of the baseball bat 58 whereby the grips 10*a* and 10*b* are adjustable to accommodate the particular grip of the user. As seen in FIGS. 8–10, the curvilinear projections 26 of the first detachable grip 10*a* are offset from the curvilinear projections 26 of the second detachable grip 10*b* such that the gripping device 54 is customized to the particular grip of the user. Therefore, the handle portion 56 may be adapted for a particular user before each use without requiring permanent deformation of the baseball bat 58. This results in reduced expense since any bat 58 may be readily customized for a user by placing the detachable grips 10*a* and 10*b* in their desired position on the handle portion 56 and then may be removed or readjusted for the next user. Further, the handgrips 10*a* and 10*b* are available in a variety of sizes thereby facilitating use by individuals with different size hands.

While the foregoing has described the detachable grip 10 applied to a baseball bat 56, it should be understood that the hand grip 10 of the present invention can be used with equal advantage in connection with any elongated member, including golf clubs, axes, hammers, etc.

Figure 11:
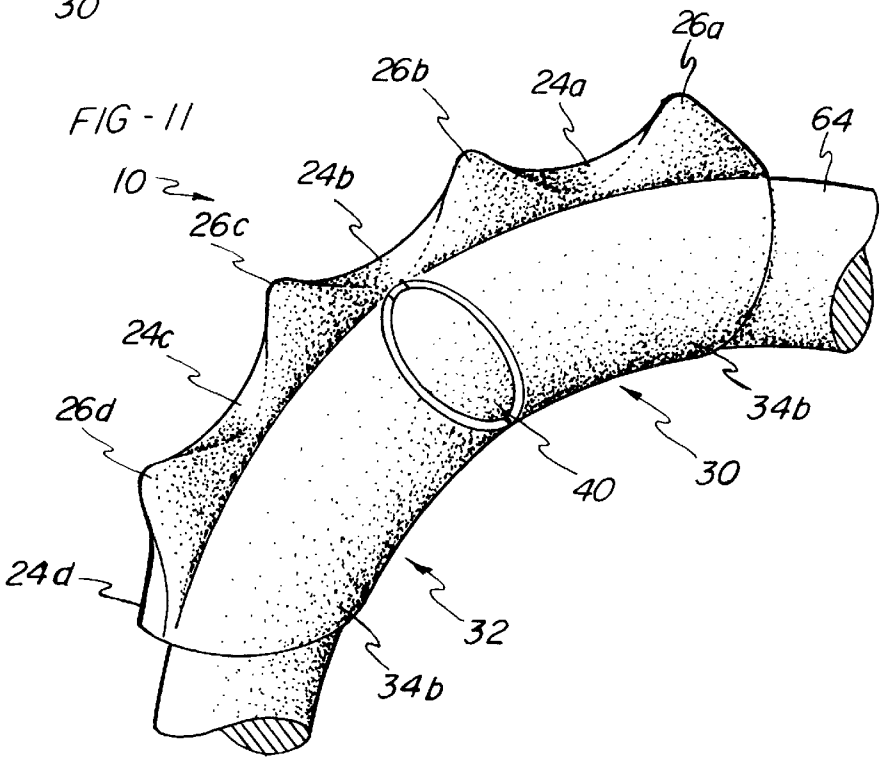
FIG. 11 is a front elevational view of the detachable hand grip of the present invention installed upon a curved elongated member.

Turning now to FIG. 11, the detachable grip 10 of the present invention is shown applied to a curved elongated member 64, such as a door handle or steering wheel. It should be appreciated that in this application, the tapered opening 40 defined by the first and second pairs 30 and 32 of resilient securing members 34 allows for the application of the detachable grip 10 to curved or tapered elongated members without the buckling or bunching of the securing members 34.

From the above description it should be appreciated that the present invention provides a detachable grip which is readily installed and adjusted upon an elongated member. Further, the present invention provides for a detachable grip which can be easily removed and replaced with substitute hand grips of varying sizes. Additionally, the detachable grip of the present invention facilitates placement about tapered or curved elongated members.

While the form of apparatus herein described and the method of operation thereof constitute preferred embodiments of the invention, it is to be understood that the invention is not limited to this precise form of apparatus and method, and that changes may be made in either without departing from the scope of the invention, which is defined in the appended claims.

What is claimed is:

1. A detachable grip for placement around an elongated member having an outer surface, said grip comprising:

a resilient body member having inner and outer surfaces, said outer surface substantially defined by a plurality of outwardly extending curvilinear projections adapted to conform to the shape of a hand of a user, said plurality of projections defining a longitudinal axis;

an arcuate gripping surface defined by said inner surface of said body member, said arcuate gripping surface extending parallel to said longitudinal axis between first and second ends of said body member and adapted to conform to and releasably engage the outer surface of the elongated member;

first and second pairs of resilient securing members extending outwardly from said body member in substantially perpendicular relation to said longitudinal axis, each said securing member having a planar inner surface, a proximal end connected to said body member and a distal end spaced a predetermined distance from said proximal end;

said first pair of securing members positioned proximate said first end of said body and said second pair of securing members positioned proximate said second end of said body;

attachment means positioned proximate said distal end of at least one of said securing members of each said first and second pairs of securing members for releasably attaching said distal ends to each other in an overlapping relationship around the outer surface of the elongated member; and wherein said arcuate gripping surface of said body member and said planar inner surface of each said securing member is adapted to frictionally engage and securely grip the outer surface of the elongated member when said distal ends of said securing members are releasably attached to each other thereby preventing rotational or axial movement of said grip relative to the elongated member.

2. The detachable grip of claim 1 wherein said resilient securing members are elastically deformable such that said predetermined distance between said proximal end and said distal end of each said securing member is extendable when said distal ends are releasably attached to each other in an overlapping relationship around the outer surface of the elongated member and said planar inner surface of each said securing member is frictionally engaging the outer surface of the elongated member.

3. The detachable grip of claim 1 wherein said body member and said securing members comprise integrally molded thermoplastic rubber.

4. The detachable grip of claim 1 wherein said proximal end of each said securing member is greater in width than said distal end of each said securing member whereby a tapered opening is formed between said first and second pairs of resilient securing members for preventing the buckling of said securing members relative to each other.

5. The detachable grip of claim 1 wherein said attachment means comprises a hook and loop fastener.

6. The detachable grip of claim 1 wherein:

a first one of said curvilinear projections is juxtaposed with said first end of said body member; and a lower finger recess is juxtaposed with said second end of said body member adjacent a second one of said curvilinear projections.

7. The detachable grip of claim 6 further comprising an orientation indicator positioned on said outer surface of said body member for facilitating the orientation of said lower finger recess.

8. The detachable grip of claim 7 wherein said orientation indicator comprises an arrow pointing toward said second end of said body member.

9. A gripping device for placement around an elongated member having an outer surface, said gripping device comprising first and second detachable grips, each said grip including:

a resilient body member having inner and outer surfaces, said outer surface substantially defined by a plurality of outwardly extending curvilinear projections adapted to conform to the shape of a hand of a user, said plurality of projections defining a longitudinal axis;

an arcuate gripping surface defined by said inner surface of said body member, said arcuate gripping surface extending parallel to said longitudinal axis between first and second ends of said body member and adapted to conform to and releasably engage the outer surface of the elongated member;

one of said curvilinear projections juxtaposed with said first end of said body member;

a lower finger recess juxtaposed with said second end of said body member;

a first pair of resilient securing members extending outwardly from said body member in substantially perpendicular relation to said longitudinal axis, each said securing member having a planar inner surface, a proximal end connected to said body member and a distal end spaced a predetermined distance from said proximal end;

attachment means positioned proximate the distal end of at least one of said securing members for releasably attaching said distal ends to each other in an overlapping relationship around the outer surface of the elongated member; and wherein said arcuate gripping surface of said body member and said planar inner surface of each said securing member are adapted to frictionally engage and securely grip the outer surface of the elongated member when said distal ends of said securing members are releasably attached to each other thereby preventing rotational or axial movement of said grip relative to the elongated member.

10. The gripping device of claim 9 wherein said curvilinear projections of said first detachable grip are circumferentially offset from said curvilinear projections of said second detachable grip and said lower finger recess of said first detachable grip is positioned above said first end of said second detachable grip.

11. The gripping device of claim 9 wherein said resilient securing members are elastically deformable such that said predetermined distance between said proximal end and said distal end of each said securing member is extendable when said distal ends are releasably attached to each other in an overlapping relationship around the outer surface of the elongated member and said planar inner surface of each said securing member is frictionally engaging the outer surface of the elongated member.

12. The gripping device of claim 9 wherein said body member and said securing members comprise integrally molded thermoplastic rubber.

13. The gripping device of claim 9 wherein each said grip further comprises a second pair of resilient securing members in spaced relation to said first pair of resilient securing members.

14. The gripping device of claim 13 wherein said proximal end of each said securing member is greater in width than said distal end of each said securing member whereby a tapered opening is formed between said first and second pairs of resilient securing members for preventing the buckling of said securing members relative to each other.

15. The gripping device of claim 9 wherein said attachment means comprises a hook and loop fastener.

16. The gripping device of claim 9 wherein:

said second end of said first grip is positioned adjacent said first end of said second grip; and said lower finger recess of said first grip is positioned intermediate said curvilinear projection proximate said second end of said first grip and said curvilinear projection proximate said first end of said second grip.

17. The gripping device of claim 7 wherein each of said grips further comprises an orientation indicator positioned on said outer surface of said body member for facilitating orientation of said lower finger recess of said first grip adjacent said first end of said second grip.

18. The gripping device of claim 17 wherein said orientation indicator comprises an arrow pointing toward said second end of each said grip.

* * * * *